US007191925B2

(12) United States Patent
Aris et al.

(10) Patent No.: US 7,191,925 B2
(45) Date of Patent: Mar. 20, 2007

(54) CLEAN CARRY APPARATUS

(76) Inventors: Sandra M. Aris, 5130 La Jolla Blvd., #A, San Diego, CA (US) 92109; Dominique P. Aris, 5130 La Jolla Blvd., #A, San Diego, CA (US) 92109

( * ) Notice: Subject to any disclaimer, the term of this patent is extended or adjusted under 35 U.S.C. 154(b) by 25 days.

(21) Appl. No.: 10/662,513

(22) Filed: Sep. 16, 2003

(65) Prior Publication Data

US 2005/0056668 A1 Mar. 17, 2005

(51) Int. Cl.
*A45F 4/02* (2006.01)

(52) U.S. Cl. ..... 224/581; 224/582; 224/653

(58) Field of Classification Search ..... 224/153, 224/577, 581, 582, 583, 645, 653, 654; 5/417, 5/420; 383/4; 190/1, 2
See application file for complete search history.

(56) References Cited

U.S. PATENT DOCUMENTS

| | | | | |
|---|---|---|---|---|
| 2,531,501 | A * | 11/1950 | Cline | 135/133 |
| 3,052,895 | A * | 9/1962 | Lo Vico | 5/417 |
| 4,631,765 | A * | 12/1986 | Casey | 5/417 |
| 4,843,662 | A * | 7/1989 | Handelman | 5/420 |
| 5,066,001 | A * | 11/1991 | Wilkinson | 482/52 |
| 5,209,384 | A * | 5/1993 | Anderson | 224/653 |
| 5,439,154 | A * | 8/1995 | Delligatti | 190/1 |
| 5,491,851 | A * | 2/1996 | Alonso | 5/420 |
| 5,666,679 | A * | 9/1997 | Ruddy | 5/417 |
| 5,785,427 | A * | 7/1998 | Godshaw | 383/4 |
| 6,193,034 | B1 * | 2/2001 | Fournier | 383/4 |
| 6,212,711 | B1 | 4/2001 | Gilmour | |
| 6,234,940 | B1 | 5/2001 | Fotsis | |
| 6,237,764 | B1 | 5/2001 | Kastelic | |
| 6,250,470 | B1 | 6/2001 | Mackenzie | |
| 6,253,944 | B1 | 7/2001 | Osten | |
| 6,264,570 | B1 | 7/2001 | Yoon | |
| 6,276,381 | B1 | 8/2001 | O'Brien | |
| 6,282,741 | B1 | 9/2001 | Manning | |
| 6,283,299 | B1 | 9/2001 | Lee | |
| 6,315,117 | B1 | 11/2001 | Han | |
| 6,318,019 | B1 | 11/2001 | Harris | |
| 6,367,674 | B1 | 4/2002 | Tabor | |
| 6,386,414 | B1 | 5/2002 | Kilduff | |
| 6,394,328 | B1 | 5/2002 | Zakarin | |
| D459,877 | S | 7/2002 | Laprise | |
| 6,416,109 | B1 | 7/2002 | Tyrer et al. | |
| 6,435,392 | B1 | 8/2002 | Kennedy | |
| 6,443,405 | B1 | 9/2002 | Han | |

(Continued)

*Primary Examiner*—Gary E. Elkins
(74) *Attorney, Agent, or Firm*—Reed Smith, LLP

(57) ABSTRACT

A clean carry apparatus provides a clean surface for use and a clean exterior after use. A storage area and base area are connected to a changing area at at least one hinge point. The base area and changing area pivot away from each other at a second hinge point to lay on a surface. The storage area pivots away from the changing area at a hinge point and rests on the base area to expose a clean changing surface. After changing, the storage area pivots back to lay flat across the changing area and contain soiled surfaces within the changing area. By lifting the clean carry apparatus, the base area and changing area pivot together, containing soiled surfaces in contact with the surface. An embodiment provides a privacy shield for changing. Another embodiment provides a foldable mat with a clean area.

22 Claims, 15 Drawing Sheets

U.S. PATENT DOCUMENTS 6,471,054 B2 10/2002 Nevarez
6,508,359 B1 1/2003 He et al.
D472,380 S 4/2003 Hillman
6,561,329 B2 5/2003 Stobbs, II et al.
6,711,766 B2 * 3/2004 Monk et al. ..... 5/420
6,793,991 B2 * 9/2004 Thuma et al. ..... 428/34.1
2002/0088053 A1 * 7/2002 Swagger, Jr. ..... 5/420

* cited by examiner

CLEAN CARRY APPARATUS

BACKGROUND OF THE INVENTION

1. Field of the Invention

The present invention relates to devices, systems, and processes useful for maintaining a clean carrying case.

2. Brief Description of the Related Art

People sometimes encounter a situation where it is desirable to have a clean surface while changing clothing or eating in an area where clean surfaces are not readily available. For example, a person might change clothes while at the beach or camping. Another example is changing a baby's diaper when a changing room or furniture is not readily available. Yet another example situation would be having a picnic. To facilitate clear discussion, the terms dirty and soiled as used herein refer to both exposure to dirt, mud, dust, and the like, as well as being wet. Likewise, the term clean refers to being free from dirt, mud, dust, water, and the like.

Trying to change clothing while maintaining cleanliness poses several problems. First, there is the problem of providing a clean surface in close proximity to the change of clothing and other changing needs. Another problem is containing wet and/or dirty surfaces after changing, so that carrying the surface and other items away does not dirty the user or his or her surroundings, such as the trunk of a car. Still another problem is separating any dirty items from other stored items. Yet another problem is allowing the user to clean up the area and store belongings without getting him or her self dirty. Providing a clean surface and storing soiled items without dirtying one's self or surroundings are problems encountered in other situations besides changing clothing, for example, having a picnic.

Known products have attempted to solve these problems in various ways. For example, the Wet and Dry Gear Bag™ made by Abel Quality Products of Camarillo, Calif., United States, provides a carpet to stand on while changing clothing. However, the carpet cannot be re-folded and stored without touching the dirty surface lying on the ground. The Navigator Wet/Dry bag made by Henri Lloyd, Henri Lloyd North America, Roswell, Ga., United States, provides compartments for wet and dry items. However, this bag does not provide a clean changing area. Further, storage compartments are not easily accessible and require stuffing and rearranging items, which in turn makes it difficult for the user to stay clean while storing items and cleaning up the area.

U.S. Pat. No. 6,212,711 to Gilmour, issued Apr. 10, 2001, describes a change and carry mat made of three layers of material (2, 3, and 6). The mat folds along a fold element 12 and is secured with a fastening element. A portion of the edges (4, 5) are not secured or sealed so that water runs off of wet clothing stored inside the folded mat. While the ability to air wet clothing prevents clothing spoilage, water and dirt can escape from inside the folded mat and dirty the user, the user's car, and other areas exposed to the mat. Further, the user is not protected from any dirt or water remaining on the outside of the mat from lying on the ground.

Although these devices generally function well and provide advantages over prior devices, the devices did not provide users with adequate adaptability, particularly with respect to use in providing clean surfaces or containing dirty surfaces.

SUMMARY OF THE INVENTION

A clean carry apparatus provides a clean surface for use and a clean exterior after use. A storage area and base area are connected to a changing area at at least one hinge point. The base area and changing area pivot away from each other at a second hinge point to lay on a surface. The storage area pivots away from the changing area at a hinge point and rests on the base area to expose a clean changing surface. After changing, the storage area pivots back to lay flat across the changing area and contain soiled surfaces within the changing area. By lifting the clean carry apparatus, the base area and changing area pivot together, containing soiled surfaces in contact with the surface. An embodiment provides a privacy shield for changing. Another embodiment provides a foldable mat with a clean area.

Still other objects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to preferred embodiments of the apparatus and method, given only by way of example, and with reference to the accompanying drawings, in which.

DESCRIPTION OF THE PREFERRED EMBODIMENTS

Figure 1:
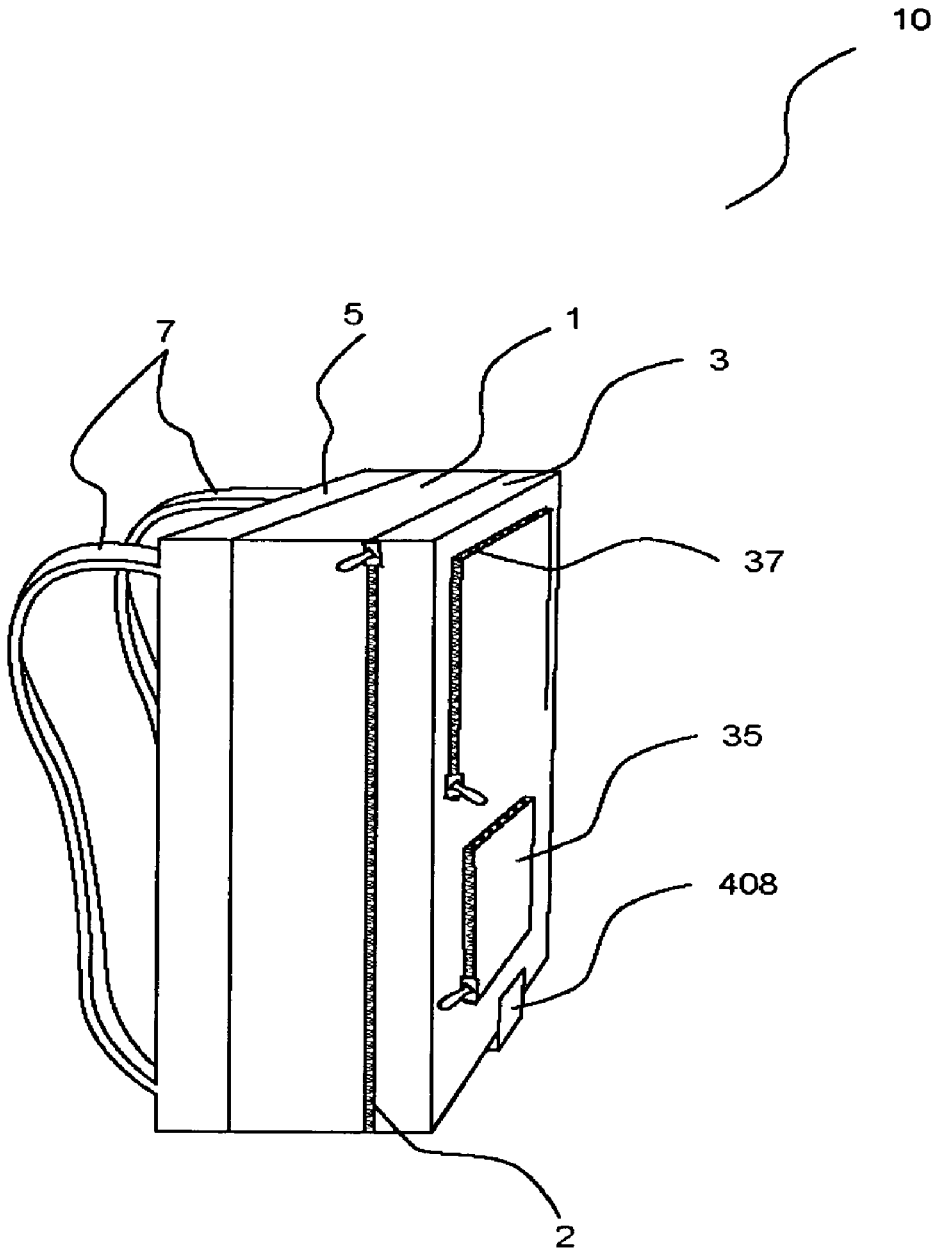
FIGS. 1 and 2 illustrate a clean carry apparatus in accordance with the present invention.

Referring to the drawing figures, like reference numerals designate identical or corresponding elements throughout the several figures.

The present invention has been made in view of the above circumstances and provides, among other things, devices for providing a clean surface and containing soiled surfaces. Additional aspects of the invention will be set forth in part in the description which follows and in part will be clear from the description, or may be learned by practice of the invention.

Figure 2:
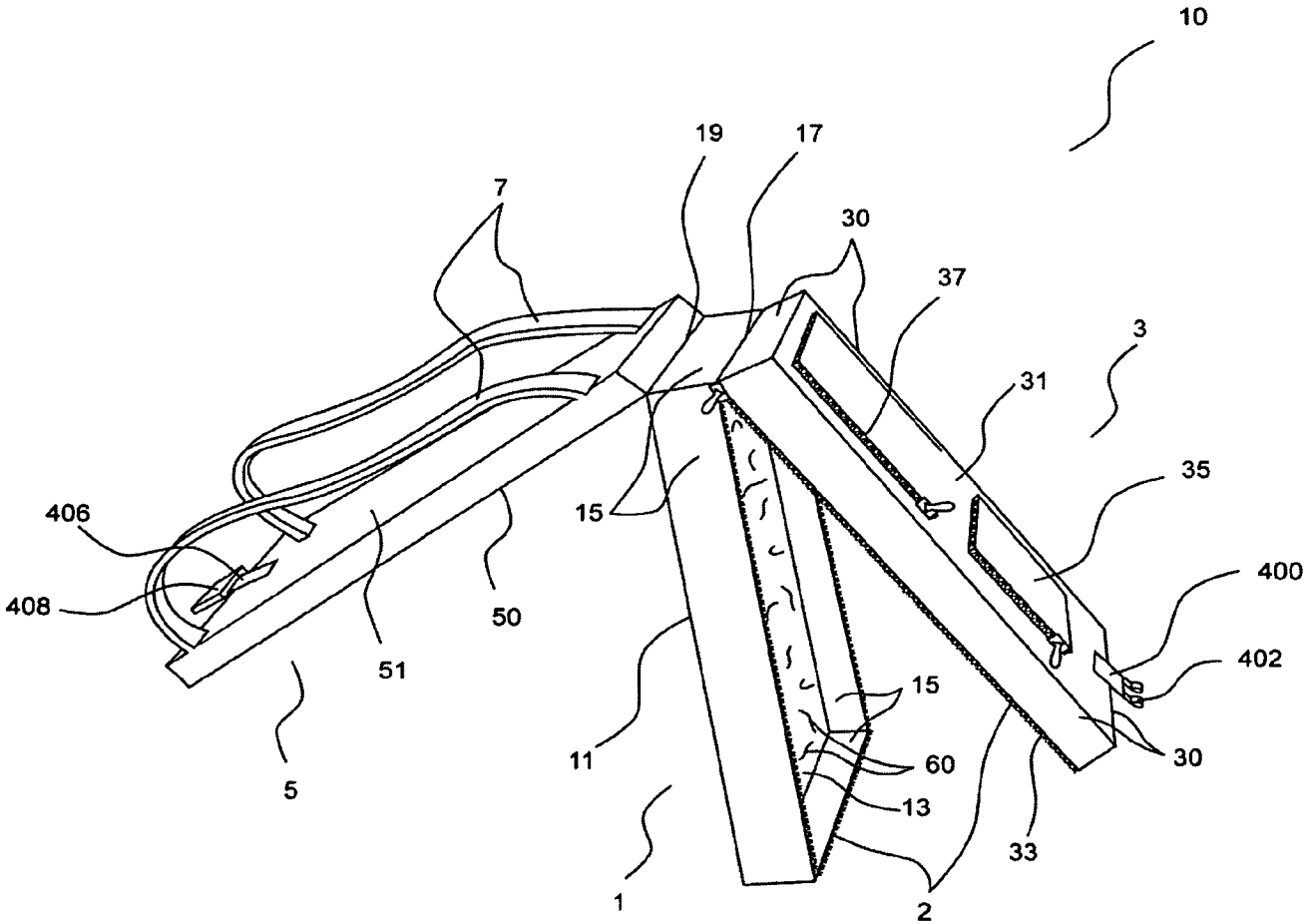

Referring to FIGS. 1 and 2, a clean carry apparatus in accordance with the present invention is illustrated. A clean carry apparatus 10 provides a clean changing surface as well as a clean outer surface once changing is complete. In FIG. 1, the clean carry apparatus 10 is illustrated in a closed position. A changing area 1 is disposed between a storage area 3 and a base area 5, and has a plurality of sides 15. A front surface of the changing area 11 sits adjacent to the base area 5 when the clean carry apparatus 10 is folded. A back surface 13 of the changing area 1 sits adjacent to the storage area 3 when the clean carry apparatus 10 is folded. Preferably, and as illustrated in FIG. 2, the back surface 13 of the changing area 1 may be recessed to form a clean area with sides, similar to an open box lid. A seal 2 may be optionally placed between the changing area sides 15 and the storage area sides 30 allowing the user to store dirty or wet clothes in the changing area. Preferably, the seal 2 is waterproof and prevents water from wet items in the changing area from escaping the changing area. Optionally, a flap may be attached to the recessed clean area with a fastening device for opening the flap, such as a zipper, to form the recessed clean area into a closable pocket. Alternatively, the back surface 13 can simply be flat, such that the clean area and sides form a mat. A first hinge point 17 extends along one of the plurality of sides 15. A second hinge point 19 also extends along the one of the plurality of sides 15 and parallel to the first hinge point 17. The changing area 13 is preferably made from material that is water-proof or water resistant, but also comfortable to stand or sit in. Suitable materials include heavy nylon coated with Gore-Tex® or Sympa-Tex®, or a sponge rubber similar to the consistency of a household shower mat. As an optional feature, treads 60 may be added to the back surface 13 of the changing area in order to provide traction and stability for someone standing on the back surface 13. The tread 60 made from a material that mitigates slipping, such as rubber, plastic. Further, treads 60 may be formed directly into the back surface 13 of the changing area. Suitable materials for incorporating treads directly include direct injection rubber padding and pattern-molded fabric.

The changing area 1 alternatively includes a covering (not shown). The covering covers the back surface 13 of the changing area. The covering attaches to the back surface 13 of the changing area by a fastening element, such as snaps, clips, magnets, hook-and-loop fastening tape, and the like. The user steps on top of the covering, which can be subsequently removed and thrown away. The covering can be made from disposable materials that are preferably moisture resistant or moisture absorbent so that the covering may simply be discarded after use. Suitable materials include paper, plastic, and Tyvek®D manufactured by DuPont® corporation. Alternatively, the covering can be made from washable materials such as cloth, canvas, sponge, towel material, cotton, waterproof nylon, and the like, so that the covering can be washed and re-used.

The base area 5 attaches to the changing area 1 along the second hinge point 19. The bottom surface of the base area 50 sits against the front surface 11 of the changing area when the clean carry apparatus 10 is folded. The bottom surface 50 can be recessed to form an open area with sides, as illustrated, or can simply be made as a flat panel. A carrying surface 51 is opposite and parallel to the bottom surface of the base area 50. Carrying means 7 is attached to the carrying surface 51. The carrying means 7 aids a person when carrying and lifting the clean carry apparatus 10. As illustrated, the carrying means 7 is a pair of shoulder straps. However, it will be appreciated by one of ordinary skill in the art that a wide variety of devices, such as handles, belts, chest straps, and the like, may be used as a carrying means without departing from the scope of the present invention.

The storage area 3 has a plurality of sides 30, and attaches to the changing area 1 at the first hinge point 17 of the changing area. The inside 33 of the storage area faces the back surface 13 of the changing area when the clean carry apparatus 10 is closed. When the clean carry apparatus 10 is opened, the storage area 3 rests against either the changing area 1 or the base area 5 as needed. This positioning isolates the storage area 3 from the ground or other dirty surfaces during use. The storage area 3 is used to store items a person would access while changing, for example extra clothing and toiletries, as well as any other items the person may want to carry, such as a water bottle, a nutrition bar, or the like, and soiled clothing after changing. The outside 31 of the storage area 3 is opposite of and parallel to the inside 33 of the storage area 3.

The storage area 3 is opened and closed with at least one seal 37. Preferably, the seal 37 is a zipper. However, other sealing devices and arrangements, for example hook-and-loop fastening tape, magnets, snaps, buckles, and the like, may be used without departing from the scope of the present invention. The seal 37 as illustrated is placed on the outside 31 of the storage area 3 such that the user can place or remove items from the closed apparatus 10. Preferably, another seal 39 is placed on the inside 33 such that the user can access the storage area 3 when the apparatus 10 is open (illustrated in FIG. 4). However, it will be appreciated by one of ordinary skill in the art that the seals 37, 39 may be arranged in a variety of ways to widely open the storage area, without departing from the scope of the present invention. For example, the seal may be placed along a substantial amount of the inside, to form a flap. Preferably, the seal extends around the majority of the storage area, and more preferably around at least two thirds of the storage area, to widely open the storage area so allowing the user to store and remove soiled items without dirtying himself or the exterior of the clean carry apparatus 10. Alternative seal arrangements place one seal on the storage area 3 on the inside 33, the outside 31, or along the plurality of sides 30.

Optionally, a pocket 35 may be added to the storage area 3. As illustrated in FIG. 2 optionally places the pocket 35 on the outside 31 of the storage area 3 for easy access to items while the clean carry apparatus 10 is folded or with the storage area 3 resting against the changing area 1 while the clean carry apparatus 10 is opened.

Optionally, a closure means secures the clean carry apparatus 10 in the folded position. Preferably, a first strap 400 with a prong 402 is attached to the storage area 3. A second strap 406 with a receptacle 408 is attached to the base area 5. The first and second straps 400, 406 are of sufficient length to span under the base 5, clean 1, and storage 3 areas. The clean carry apparatus 10 is held closed by fitting the prong 402 into the receptacle. It will be appreciated by one of ordinary skill in the art that a wide variety of closure means, for example, straps, buckles, rings, ties, and combinations thereof, may be used to secure the clean carry apparatus 10 in the closed position without departing from the scope of the present invention.

Figure 3A:
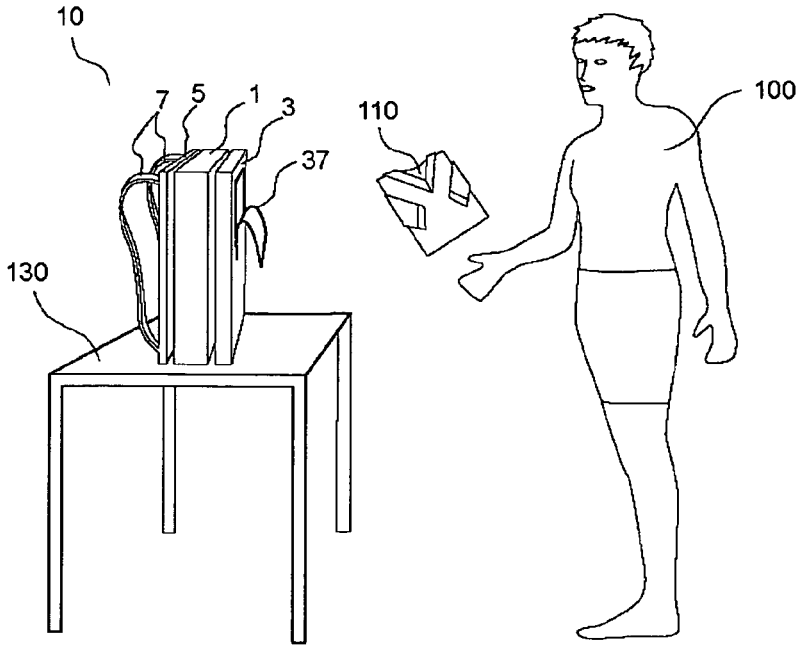
FIGS. 3A through 3H illustrate use of a clean carry apparatus in accordance with the present invention.
Figure 3B:
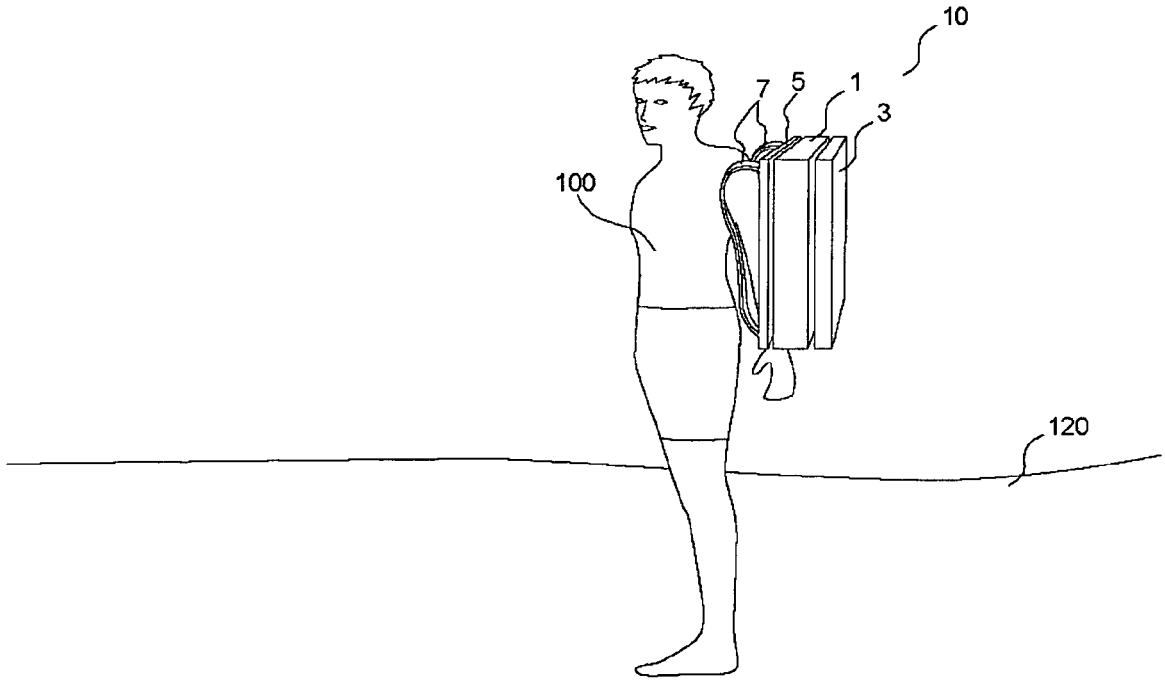

Referring to FIGS. 3A through 3H, use of a clean carry apparatus is illustrated. Referring to FIG. 3A, a user 100 prepares for some activity with the clean carry apparatus 10. The clean carry apparatus 10 is on a clean surface 130, for example, a table. The user 100 removes or places items 110, for example clothing, from the storage area 3, through the seal 37. Referring to FIG. 3B, the user 100 holds the clean carry apparatus 10 on his back in a folded position by placing his arms through the carrying means 7, in this illustration, shoulder straps. In the folded position, the base area 5 rests against the user's 100 back.

Figure 3C:
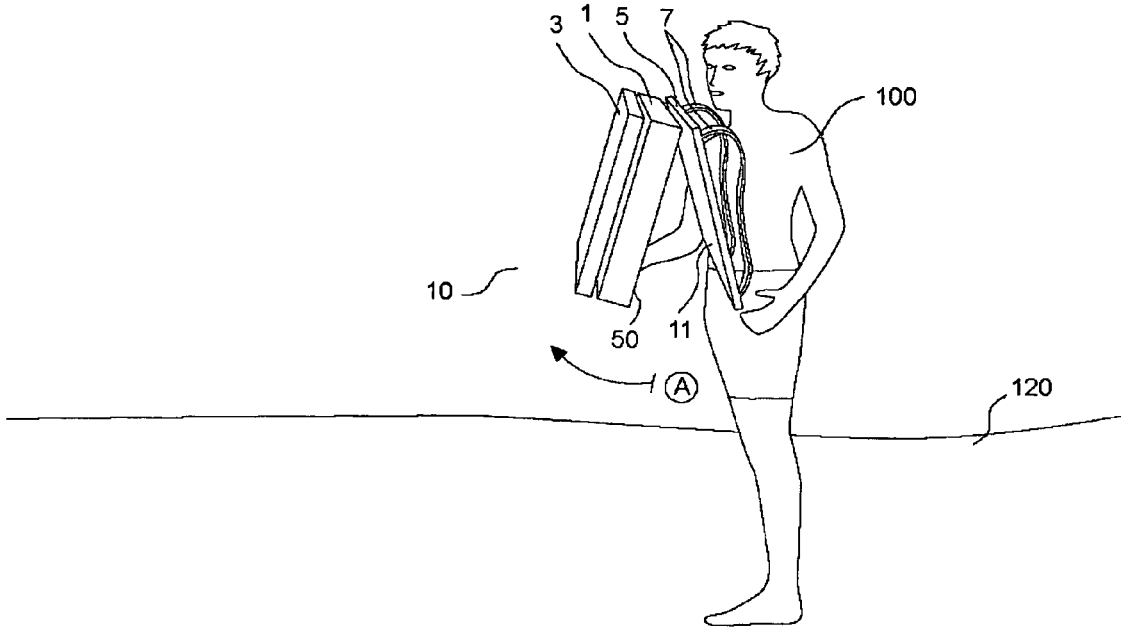
Figure 3D:
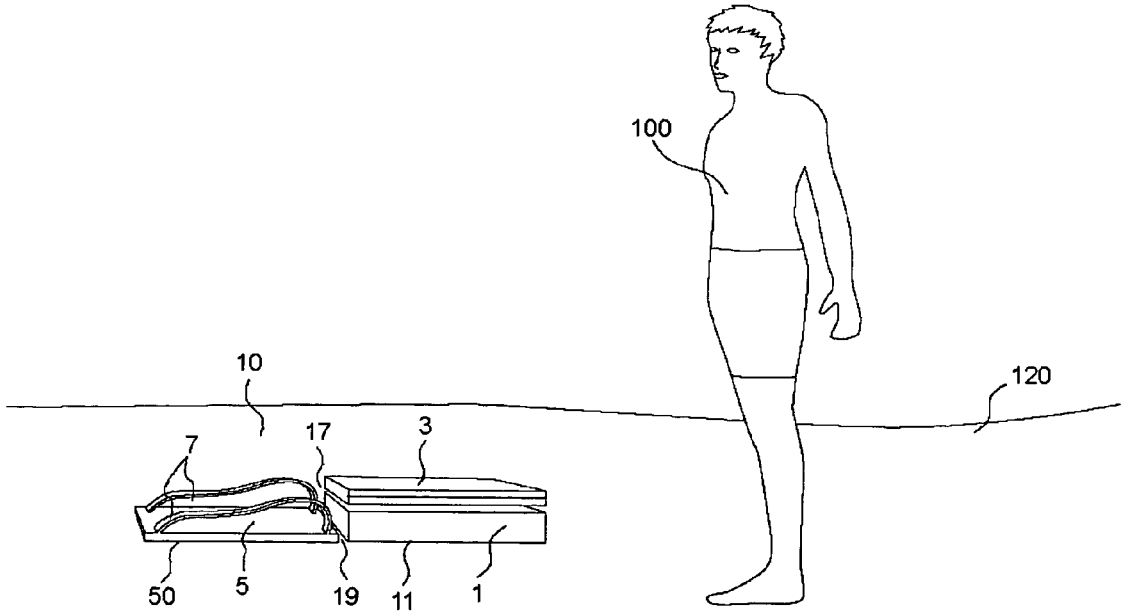

Referring to FIGS. 3C and 3D, to open the clean carry apparatus 10, when using embodiments having a closure means securing the clean carry apparatus 10 in the closed position, the user 100 must first open the closure means. The user 100 pivots changing area 1 and storage area 3 away from the base area 5 in the direction of arrow A, allowing the changing area 1 to rotate about the second hinge point 19. The changing area 1 and storage area 3 move to allow the user 100 to place the clean carry apparatus 10 on the ground 120, with the base area bottom surface 50 and the changing area front surface 11 in contact with the ground 120. Storage area 3 is easily accessible through the seal 37 when the apparatus 10 is closed. When the apparatus 10 is open, the storage area 3 is easily accessible through the seal 39. Both seals 37 and 39 access the same pocket, i.e., the storage area 3. Where the single seal alternative (previously described) is used, the storage area 3 is easily accessed via either the inside 31, the outside 33, or along the plurality of sides 30. Similarly, in the alternative embodiment previously described having pocket 35, pocket 35 is easily accessible when the storage area 3 rests against the changing area 1.

Figure 3E:
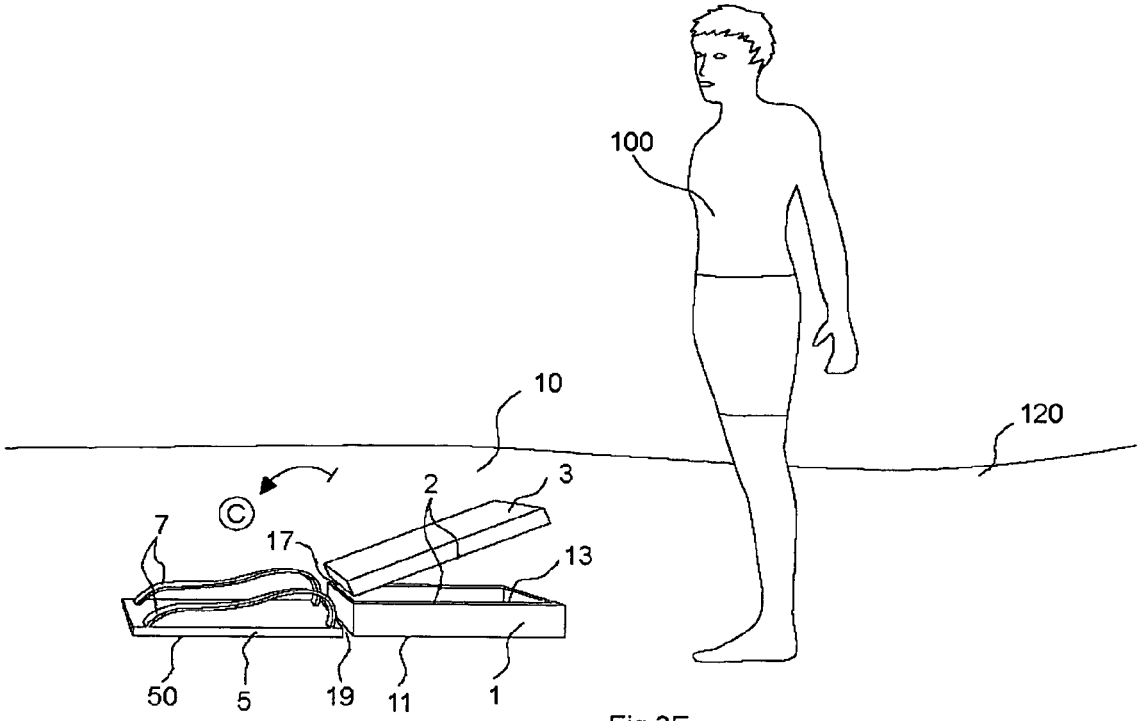
Figure 3F:
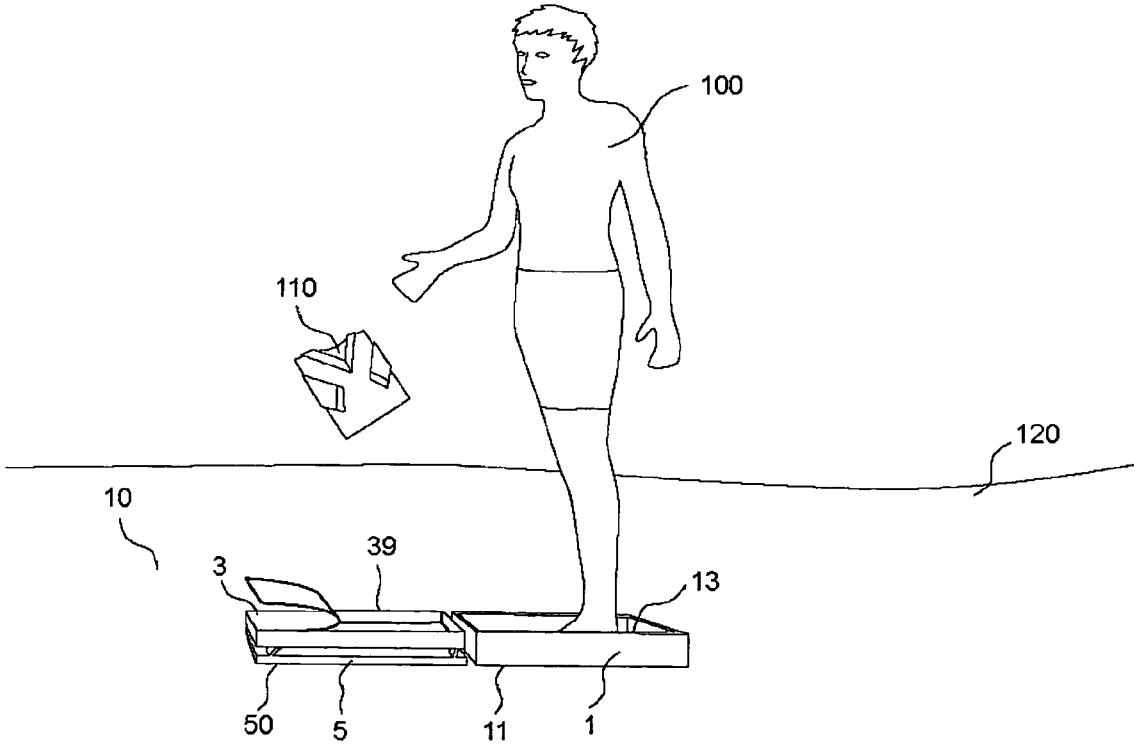

Next, referring to FIGS. 3E and 3F, the user 100 pivots the storage area 3 about first hinge point 17 in the direction illustrated by arrow C. Storage area 3 rests against the base area 5. The user 100 steps on to the clean surface/changing area back surface 13. The user 100 then can leave dirty clothing in side the changing area 1, and dons clean clothing, especially clean shoes, while on the clean surface 13. The user 100 puts dirty items inside the changing area 1 in contact with changing area back surface 13, and secures the seal 2. As previously described having seals placed on both the outside 31 of the storage area 3 and the inside 33 of the storage area 3, the storage area 3 is now easily accessible through the seal on the inside 33 of the storage area 3 when the storage area 3 rests against the base area 5.

Figure 3G:
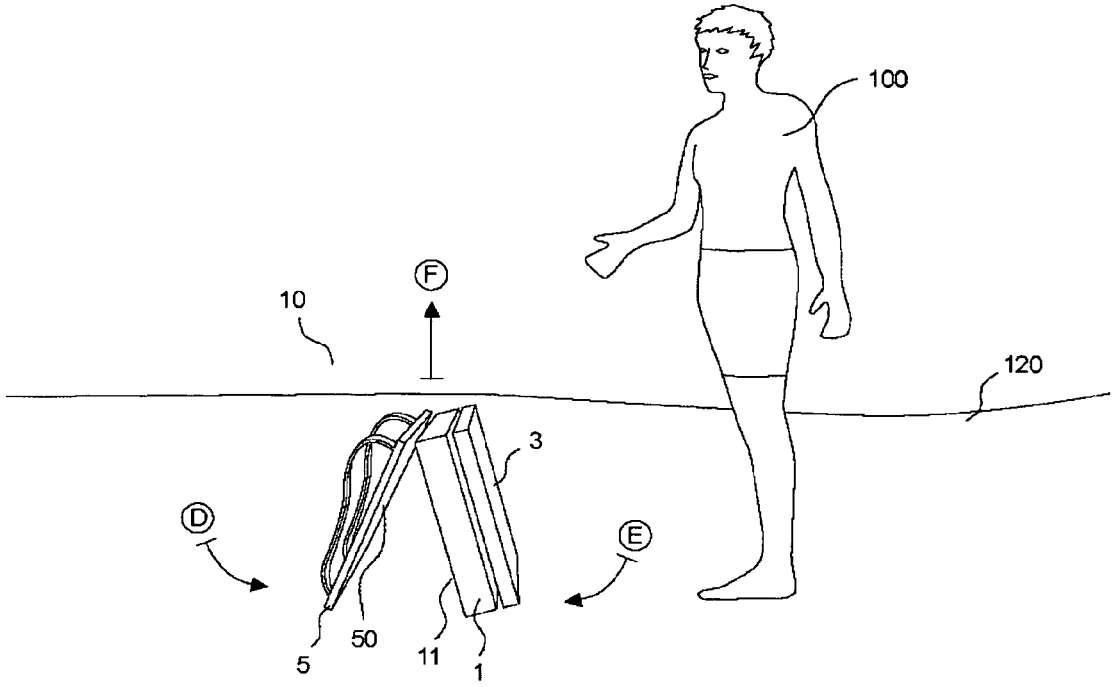
Figure 3H:
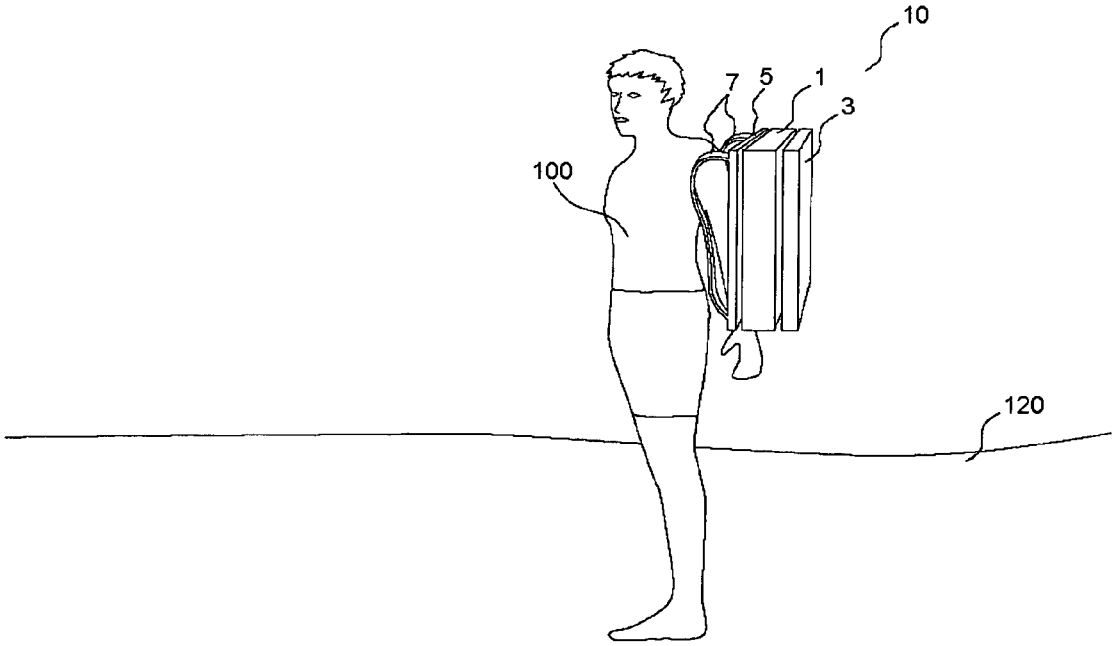

Referring to FIGS. 3G and 3H, after changing, the user steps out of the changing area 3 to re-fold the clean carry apparatus 10. The user 100 turns storage area 3 about first hinge point 17 to sit against changing area 1. This re-positioning of the storage area 3 covers any dirty area of the changing area 1, and keeps the user 100 or anything coming into contact with the clean carry apparatus 10 clean. Next, the user 100 raises the apparatus 10 in the direction illustrated by arrow F. Preferably, the user 100 simply does so by grasping the carrying means 7. However, additional handles, tabs, or other items making it easier for the user 100 to grasp the apparatus 10, may be placed on the exterior of the clean carry apparatus 10. As the user 100 pulls the clean carry apparatus 10 upwards along arrow F, the base area 5 pivots around hinge point 19 and moves along the arc illustrated by arrow D. At the same time, the changing area 1 pivots about the first hinge point 17, and the changing 1 and storage 3 areas move along the arc illustrated by arrow E, until the base area bottom surface 50 and the changing area front surface lay against. The user 100 can then place the carrying apparatus on his back without worrying about getting dirty.

Figure 2A:
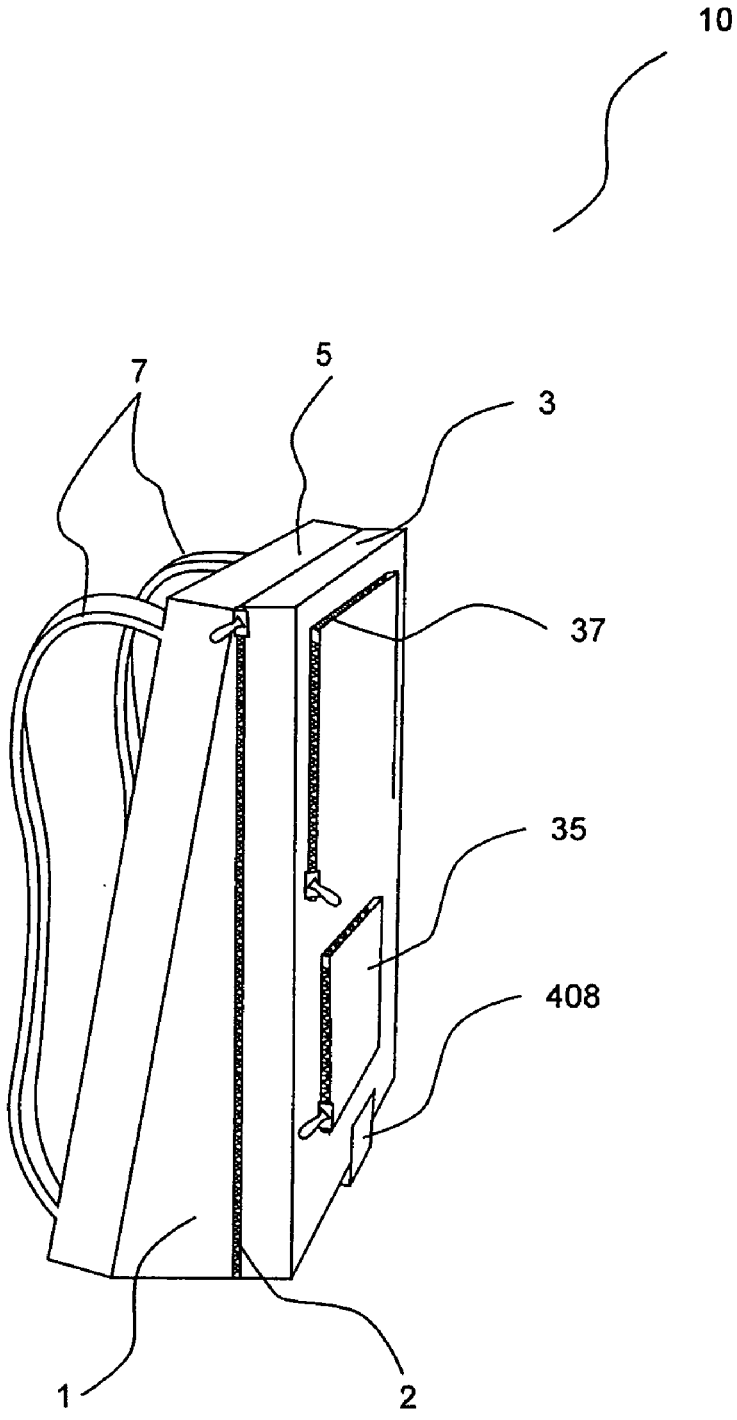
FIGS. 2A and 2B illustrate a clean carry apparatus in accordance with the present invention having a single hinge.
Figure 2B:
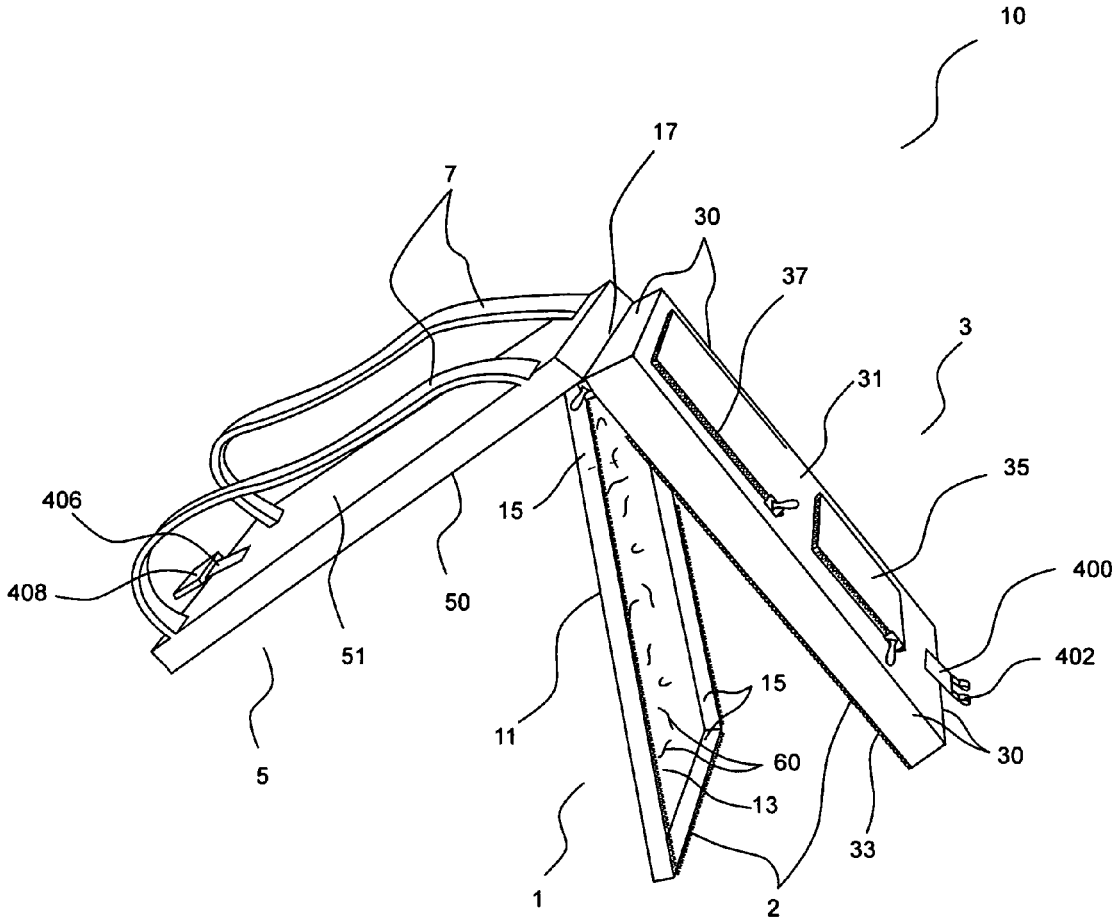
Figure 2C:
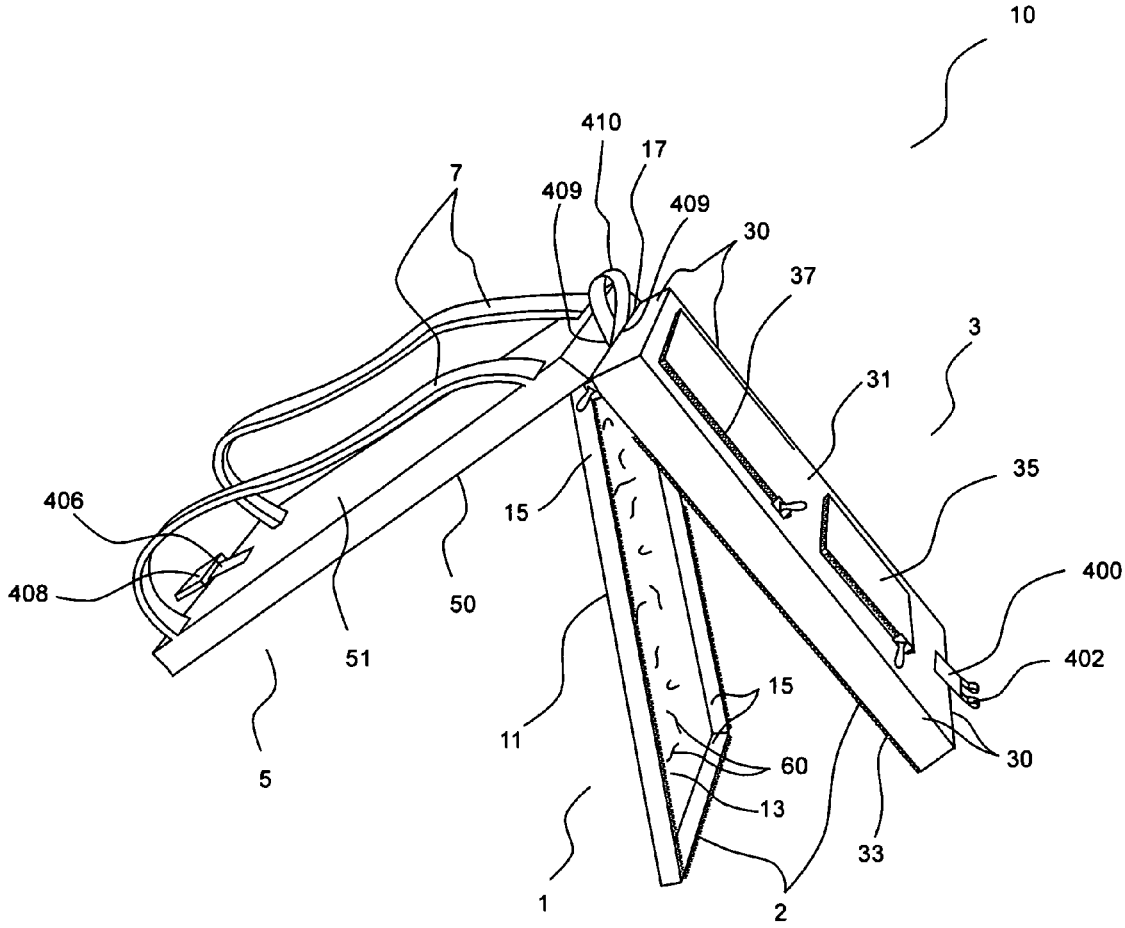
FIG. 2C illustrates a clean carry apparatus in accordance with the present invention having a hole and strap hinge.

The present invention can further be constructed with a single hinge point. See FIGS. 2A and 2B. A variety of attachment mechanisms can be used to attach the changing area 1, storage area 3, and base area 5. For example, tabs extending from each of the changing area 1, storage area 3, and base area 5 may be sewn together to form a hinge point. Also, as shown in FIG. 2C, a finished hole 409 can be placed in adjacent sides of each area 1,3, 5, with a strap 410, ring, or other joining device linking each area to form a single hinge point.

Figure 4:
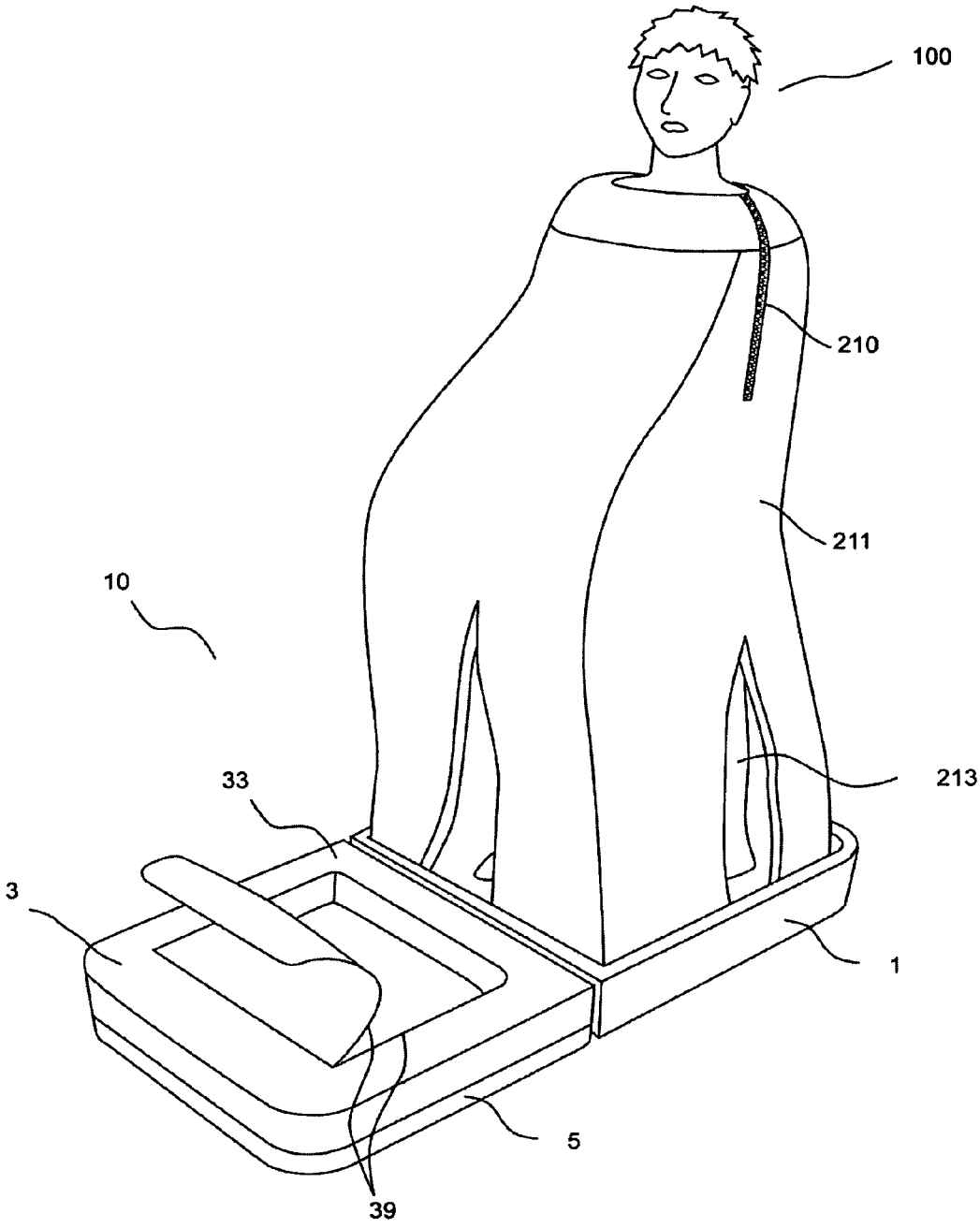
FIG. 4 illustrates a privacy shield alternative embodiment of a clean carry apparatus in accordance with the present invention.

Referring to FIG. 4, an alternative embodiment of the clean carry apparatus 10 is illustrated. The embodiment illustrated is similar to that of FIGS. 1–2 and 3A–3H, with the addition of a privacy shield 200. The privacy shield 200 is attached to the changing area 1. In a preferred embodiment, the privacy shield 200 is removably attached to a recessed clean area 13. A fastener or fasteners, for example, zippers, snaps, or hook-and-loop fastening tape secure the privacy shield 200 to the clean area 3. A securable opening 210 allows the user 100 to open the privacy shield 200 and step through to the clean surface 13 without detaching or tangling the privacy shield 200. Once under the privacy shield 200, the user 100 can then close the securable opening 210 while changing. The securable opening 210 can be opened and closed with a variety of fasteners, such as zippers, snaps, and the like. Since the clean area is recessed 13, the user 100 can simply open the securable opening 210, slide the privacy shield 200 towards the clean area 13, and arrange the privacy shield 200 while only touching the outside 211. Any dirt or water on the user's clothing will only contact the inside 213 of the privacy shield 200. Thus, the user 100 can stow the privacy shield 200 without touching the dirty inside 213 surface.

Referring to FIGS. 5A through 5E, a clean carry apparatus with a foldable mat 500 in accordance with the present invention is illustrated. The clean carry apparatus 500 has a storage area 502 and a mat 600 attached to the storage area at a first hinge point 521. Preferably, the mat 600 is detachable at or near the first hinge point 521 so that the mat 600 can be removed for easy cleaning. A detachment mechanism, for example, a zipper, snaps, buttons, or hook and loop fastening tape can be used to attach the mat 600 to the storage area 502 along or adjacent to the first hinge point 521.

Figure 5A:
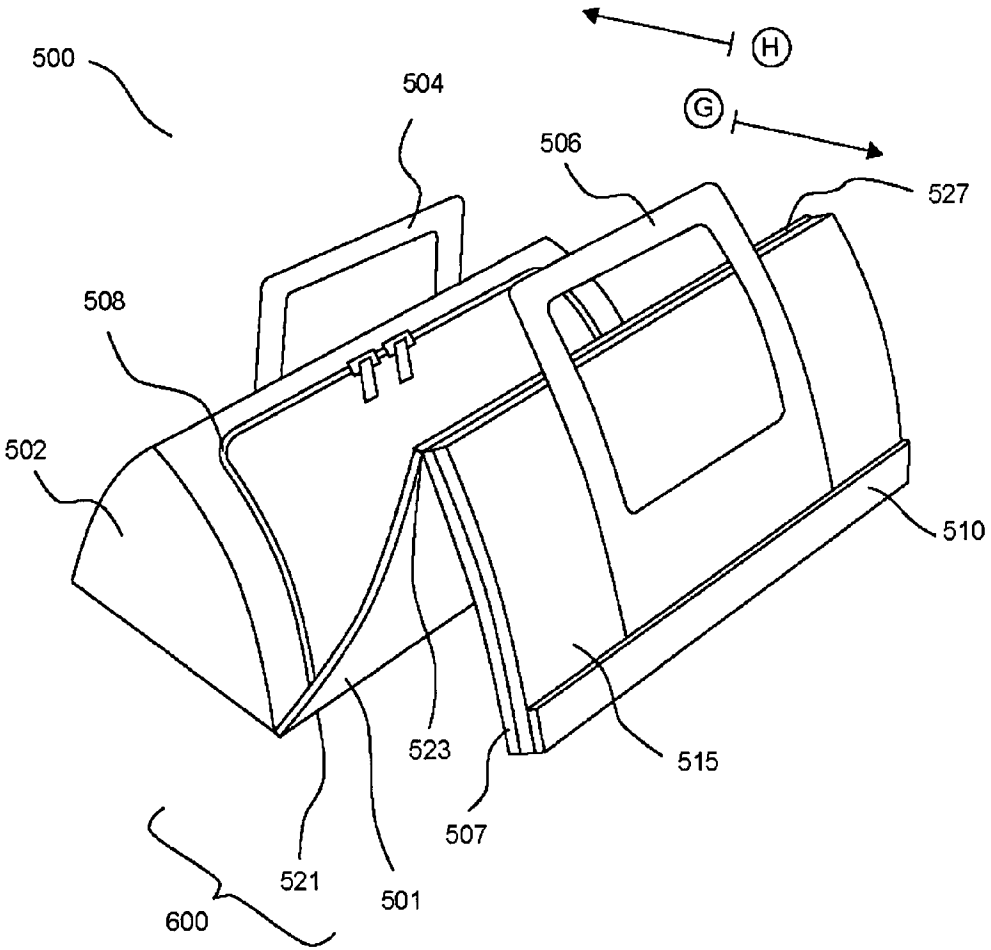
FIGS. 5A through 5E illustrate an alternative embodiment of a clean carry apparatus in accordance with the present invention.
Figure 5B:
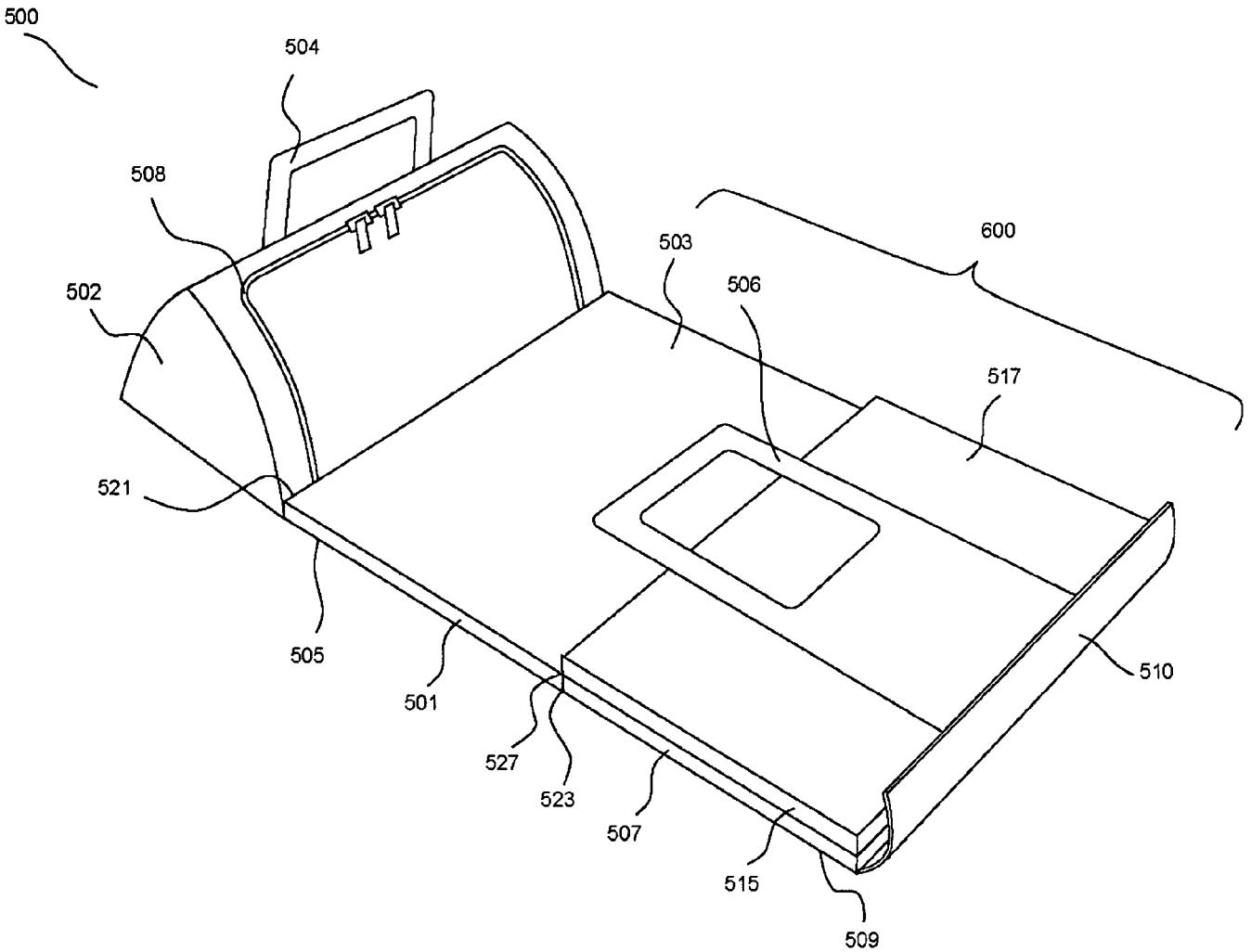
Figure 5C:
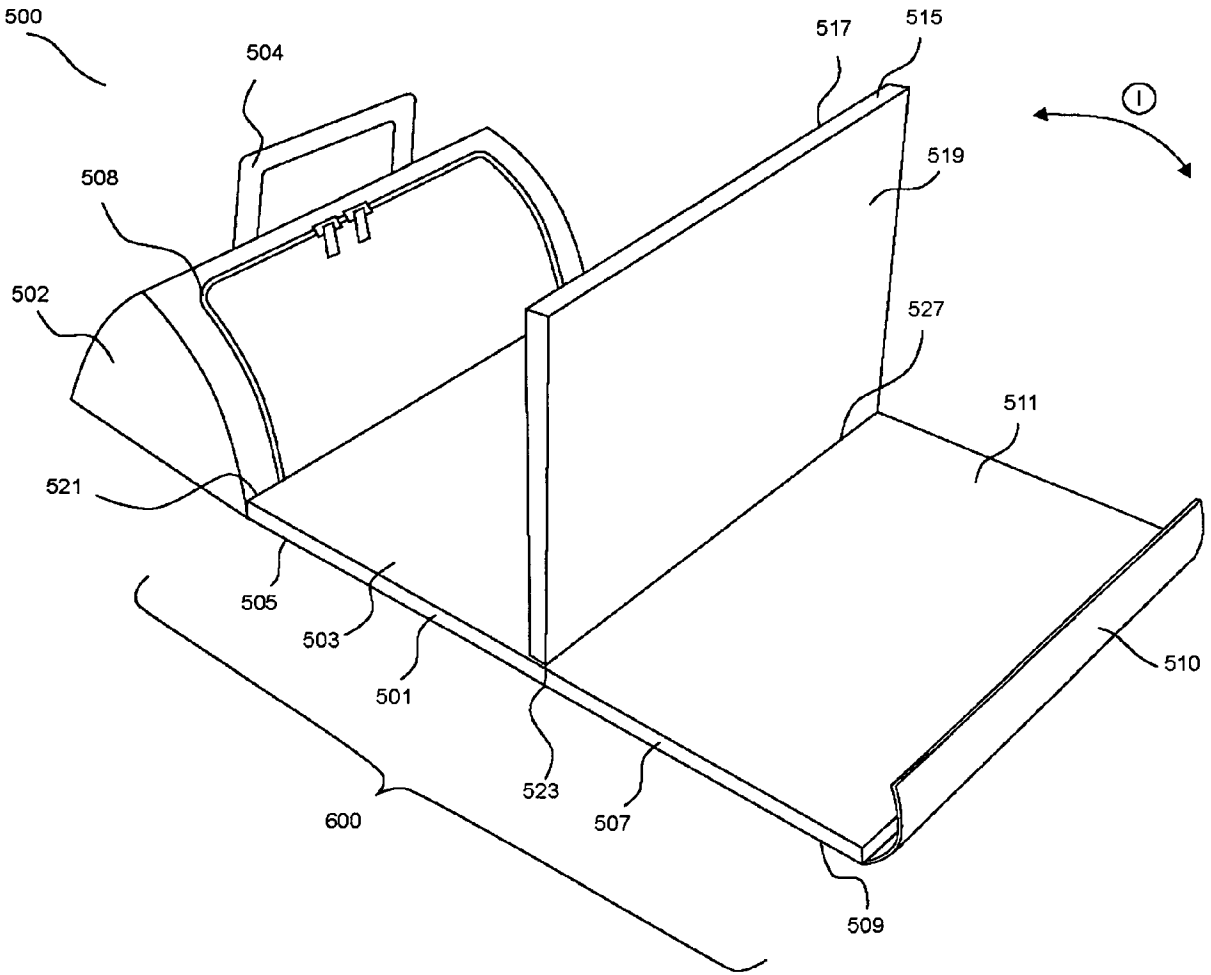
Figure 5D:
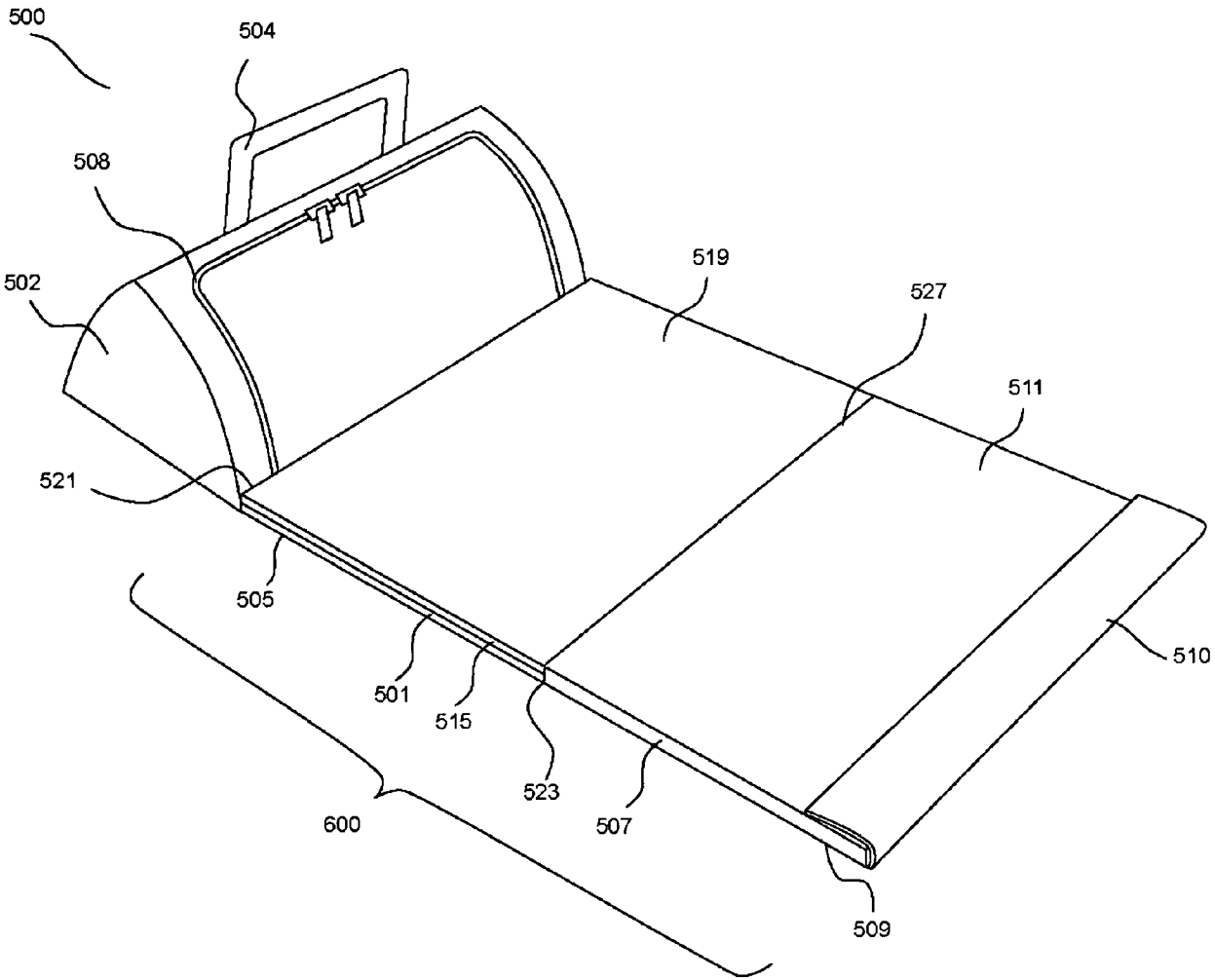

A sealable flap 508 provides access to the storage area 502. Preferably, the sealable flap 508 uses a zipper to open or close the flap 508. However, it will be appreciated by one of ordinary skill in the art that a wide variety of fasteners, such as snaps, buttons, and the like, may be used without departing from the scope of the present invention. The sealable flap 508 is covered when the mat 600 is in a folded position. Optionally, a second access point (not shown) may be added to the storage area 502 so that the storage area can be easily accessed while the mat 600 is in the folded position. For example, a zipper may be placed on the top side between handles 504 and 506, or another sealable flap can be placed on a side of the bag not covered by the mat 600 in the folded position. As illustrated in FIG. 5A, the mat 600 unfolds away from the storage area 502 and along the direction of arrow G, and folds toward the storage area 502 and along the direction of arrow H. A first handle 504 attached to the top of the clean carry apparatus 500 aids in carrying the apparatus 500. A sealed flap 508 provides access to the inside of the storage area when open, and secures items inside the storage area 502 when closed.

The foldable mat 600 is formed from a first panel 501, second panel 507, and third panel 515. The first panel 501 has a top side 503 and a bottom side 505, and connects to the storage area 502 at a first hinge point 521. The first hinge point 521 extends along the length of the first panel 501 and storage area 502, and allows the first panel 501 to rotate towards and away from the storage area 502. The second panel 507 has a top side 511 and a bottom side 509 and attaches to the first panel at a second hinge point 523. The second hinge point 523 lies adjacent to the bottom sides 505, 509, of the first and second panels, 501, 507, respectively. The third panel 515 has a top side 517 and a bottom side 519 (illustrated in FIGS. 5C through 5E). A second handle 506 attaches to the top side 517 of the third panel. A third hinge point 527 attaches the third panel 515 to the first 501 and second 507 panels adjacent to the top sides 503, 511. Optionally, a bumper 510 provides a base for the mat 600 when the mat is in a folded position. Bumper 510 holds the third panel 515 and second panel 507 together so that the mat stay closed when the bag is being carried. Bumper 510 can be secured with a wide variety of devices, for example, snaps, Velcro, buckles, and the like.

The clean carry apparatus 500 is carried in a folded position with all panels folded against the storage area 502, in the direction of arrow H in FIG. 5A, such that the first and second handles, 504, 506 meet, and a user can put his or her hand through both handles 504, 506. To unfold the mat 600, the second handle 506, the bumper 510, or the second 507 and third 515 panels are grasped and pulled away from the storage area 502 in the direction of arrow G of FIG. 5A, until the bottom side of the first panel 505 and the bottom side of the second panel 509 lay on a surface. The third panel 515 is then pivoted about the third hinge point 527, as illustrated by arc I of FIG. 5C, until the top of the third panel 517 meets the top of the first panel 503. The second handle 506 tucks between the first 501 and third 515 panels. The bottom of the third panel 519 and the top of the second panel 511 form a clean area.

Figure 5E:
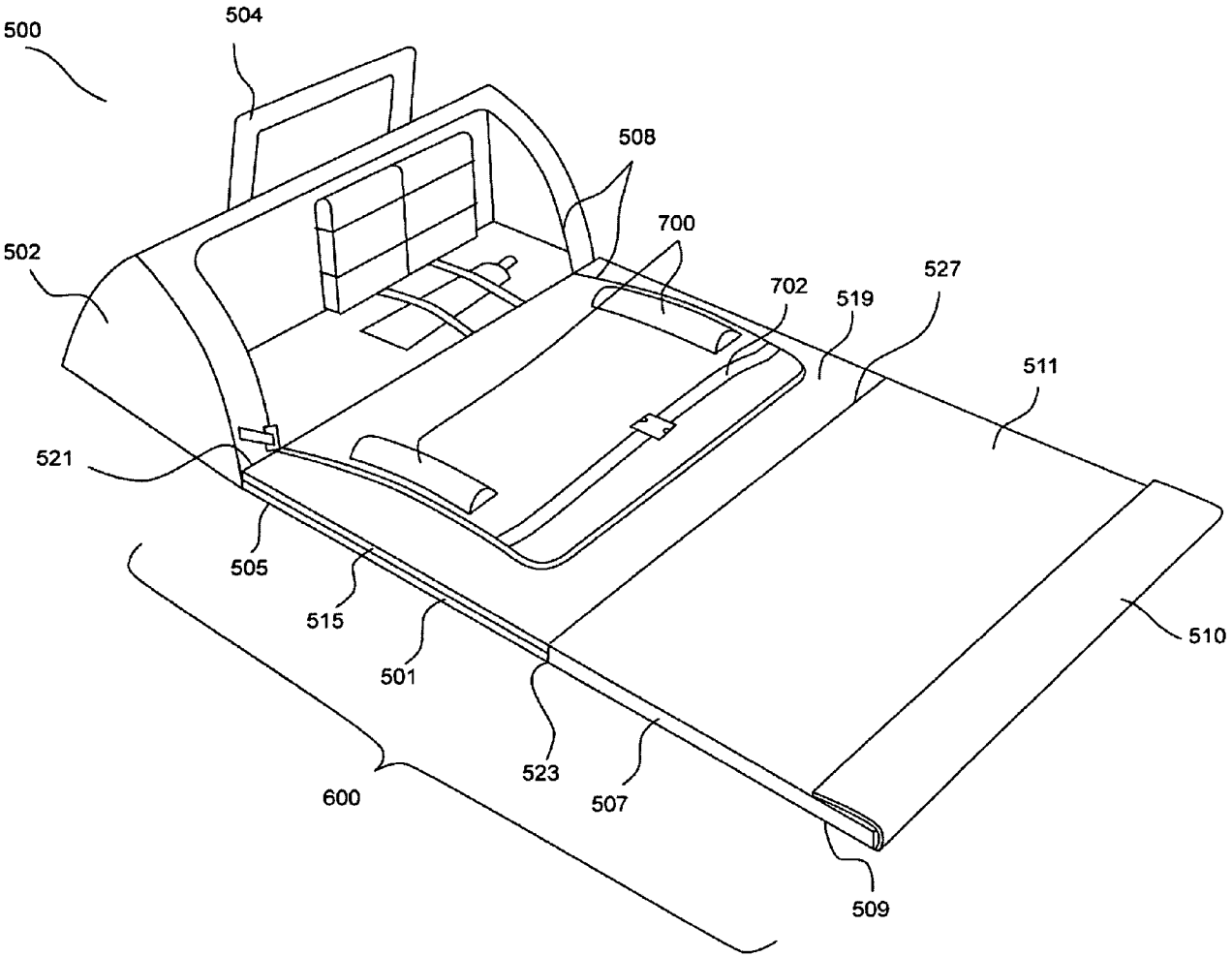

Once the clean area is exposed, the sealable flap 508 can be opened to access any items kept in the storage area 502. As illustrated in FIG. 5E, the sealable flap 508 optionally has one or more raised stops 700 and a retaining strap 702. The raised stop(s) 700 and the retaining strap 702 are particularly suited to a diaper bag alternative embodiment of the clean carry apparatus 500. Both the raised stops 700 and the retaining strap 702 prevent a baby from rolling while having his or her diaper changed. Although the raised stop(s) 700 and the retaining strap 702 are illustrated placed on the sealable flap 508, it will be appreciated by one of ordinary skill in the art that the raised stop(s) 700 and the retaining strap 702 may be incorporated into the clean carry apparatus 500 in a variety of placements without departing from the scope of the present invention. Particularly, the raised stop (s) 700 and the retaining strap 702 may be incorporated into the foldable mat 600, and more particularly into the top of the second panel 511.

During use, the clean area provided by the bottom of the third panel 519 and the top of the second panel 511 becomes soiled. However, in the folded position, the soiled areas are contained, and dirt will not contact other surfaces, such as a user's clothing, or the trunk of a car. To return the mat 600 to the folded position, the sealable flap 508 is closed. The third panel 515 is pivoted around the third hinge point 527 until the bottom 519 lies against the top of the second panel 511. Next, the mat 600 is raised with the first panel pivoting about the first hinge point 521 with the top side 503 moving towards the storage area 502, and the second 507 panel pivoting about the second hinge point 523 with the bottom side of the second panel 509 moving towards the bottom side of the first panel 505, until the mat 600 lays against the storage area 502.

Alternatively, the mat 600 can be constructed such that the second hinge point 523 and third hinge point 527 are actually one hinge point. In this embodiment, the first 501, second 511, and third 515 panels join at the one hinge point. The mat 600 operates essentially as previously described, but with the second 511 and third 515 panels pivoting about the one hinge point.

It will be appreciated by one of ordinary skill in the art that the embodiments of the clean carry apparatus of the present invention can be made from a wide variety of materials. Preferable materials are both washable and stain-resistant. Examples include coated nylon, Teflon® fabric, cotton, sponge, towel fabric, antibacterial fabric, i.e., fabric treated with an antibacterial agent such as Microban®, or backed foam fabric.

While the clean carry apparatus 10 illustrated in FIGS. 1, 2, 3A–3H, and 4, is illustrated in a generally rectangular shape; it will be appreciated by one of ordinary skill in the art that the apparatus 10 can be formed in a wide variety of shapes. For example, the clean carry apparatus 10 can be fabricated in circular, octagonal, triangular, elliptical, square, hexagonal, and pentagonal shapes. Any shape that does not interfere with carrying the apparatus and storing soiled and other items within the apparatus is contemplated in accordance with the present invention.

While the clean carry apparatus 10, illustrated in accordance with the present invention, includes a carry means 7 that allows a user 100 to carry the apparatus 10 on his back, it will be appreciated by one of ordinary skill in the art that the apparatus 10 may be designed to be carried in a variety of ways, for example, by hand, or over a shoulder, without departing from the scope of the present invention. Likewise, while clean carry apparatus 500 is illustrated with a carry means 504, 506 in the form of a first handle 504 and a second handle 506, it will be appreciated by one of ordinary skill in the art that the apparatus 500 may be designed to be carried in a variety of ways, for example, on the back, or over a shoulder, without departing from the scope of the present invention.

While the invention has been described in detail with reference to preferred embodiments thereof, it will be apparent to one skilled in the art that various changes can be made, and equivalents employed, without departing from the scope of the invention.

What is claimed is:

1. A carrying apparatus comprising:

a changing area comprising a front surface, a back surface, a plurality of sides, and a first hinge point and a second hinge point for allowing different compartments to pivot toward and away from each other;

a storage area having a plurality of sides and attached at one of the plurality of sides to the changing area along the first hinge point of the changing area and positioned against the back surface of the changing area; and a base area having a bottom surface and a carrying surface, and a plurality of sides, the base area attached at one of the plurality of sides to the changing area along the second hinge point of the changing area;

wherein the carrying apparatus is positioned on the ground by folding the base area away from the changing area at the second hinge point with the base area bottom surface and the changing area front surface against the ground, and the changing area is exposed by pivoting the storage area about the first hinge point to be positioned against the carrying surface of the base area, and wherein the carrying apparatus is removed from the ground by raising the side of the changing area having the first and second hinge point upward such that the bottom surface of the base area pivots at the second hinge point to lay against the front of the changing area and the storage area pivots about the first hinge point to lay against the back side of the changing area.

2. The carrying apparatus of claim 1, wherein the first and second hinge points are disposed parallel to each other along one of the plurality of sides of the changing area.

3. The carrying apparatus of claim 1, the base area further comprising:

a carrying means attached to the carrying surface.

4. The carrying apparatus of claim 1, further comprising a tread for providing stability disposed along the back side of the changing area.

5. The carrying apparatus of claim 1, the changing area further comprising a privacy shield.

6. The carrying apparatus of claim 5, wherein the privacy shield is attached to the changing area.

7. The carrying apparatus of claim 1, the storage area further comprising at least one seal for securing items inside the storage area.

8. The carrying apparatus of claim 7, wherein the seal is a zipper extending along a substantial amount of the plurality of sides.

9. The carrying apparatus of claim 1, the storage area further comprising an inside, an outside, a seal disposed on the inside of the storage area and a seal disposed on the outside of the storage area.

10. The carrying apparatus of claim 9, wherein the seals are zippers extending along a substantial amount of the inside and the outside of the storage area.

11. The carrying apparatus of claim 1, wherein the changing area is recessed.

12. The carrying apparatus of claim 11, the changing area further comprising a flap and a fastening device for opening the flap.

13. The carrying apparatus of claim 1 further comprising at least one seal disposed between the changing area and the storage area allowing the user to store dirty or wet clothes in the changing area.

14. The carrying apparatus of claim 13, wherein the seal is waterproof.

15. The carrying apparatus of claim 1 further comprising a pocket.

16. The carrying apparatus of claim 1, the changing area further comprising a covering attached to the back surface of the changing area for providing protection from soil.

17. The carrying apparatus of claim 16, wherein the covering is made from a material selected from the group consisting of: paper, plastic, cloth, canvas, sponge, towel material, cotton, or water-proof nylon.

18. The carrying apparatus of claim 1, wherein the changing area is made from a material that is water-proof or water resistant and comfortable to stand or sit in.

19. The carrying apparatus of claim 18, wherein the changing area material is selected from the group consisting of: coated nylon and sponge rubber.

20. The carrying apparatus of claim 1, further comprising a closure means for securing the carrying apparatus in a closed position.

21. The carrying apparatus of claim 1, wherein the carrying apparatus is made from a washable, stain-resistant material.

22. The carrying apparatus of claim 21, wherein the carrying apparatus material is selected from the group consisting of: coated nylon, cotton, sponge, towel fabric, antibacterial fabric, or backed foam fabric.

* * * * *